US005818055A

United States Patent [19]

Franzen

[11] Patent Number: 5,818,055

[45] Date of Patent: Oct. 6, 1998

[54] METHOD AND DEVICE FOR INJECTION OF IONS INTO AN ION TRAP

[75] Inventor: Jochen Franzen, Bremen, Germany

[73] Assignee: Bruker-Franzen Analytik GmbH, Bremen, Germany

[21] Appl. No.: 891,116

[22] Filed: Jul. 10, 1997

[30] Foreign Application Priority Data

Jul. 12, 1996 [DE] Germany ..... 196 28 179.2

[51] Int. Cl.[6] ..... H01J 49/42

[52] U.S. Cl. ..... 250/292

[58] Field of Search ..... 250/292, 290, 250/291, 293, 281, 282, 396 R

[56] References Cited

FOREIGN PATENT DOCUMENTS 2301705 12/1996 United Kingdom .
2302985 2/1997 United Kingdom .

*Primary Examiner*—Kiet T. Nguyen

[57] ABSTRACT

An ion trap consists of separating the ions into ion packages within an electrical travelling wave field operated at the frequency of the drive voltage for the ion trap, or at an integral fraction of the same, transporting the ion packages by the travelling wave field to the ion trap, and injecting the ion packages into the ion trap with a favorably selected velocity and at the correct point in time. A slowing-down path at the end of the travelling field allows ions of a greater mass to be injected somewhat earlier than light ions, whereby the simultaneous capture of ions of different masses becomes more favorable.

11 Claims, 4 Drawing Sheets

METHOD AND DEVICE FOR INJECTION OF IONS INTO AN ION TRAP

The invention concerns a method and a device for injection of externally generated ions into an RF quadrupole ion trap after Paul. The invention consists of separating the ions into ion packages within an electrical travelling wave field operated at the frequency of the drive voltage for the ion trap, or at an integral fraction of the same, transporting the ion packages by the travelling wave field to the ion trap, and injecting the ion packages into the ion trap with a favorably selected velocity and at the correct point in time. A slowing-down path at the end of the travelling field allows ions of a greater mass to be injected somewhat earlier than light ions, whereby the simultaneous capture of ions of different masses becomes more favorable.

PRIOR ART

The introduction of mass spectrometric methods into biochemistry, particularly in DNA and protein research, is still impaired by the high consumption of substance needed for these methods. In order to arrive at a useful mass spectrometric result with a few attomols of a substance (1 attomol≈600,000 molecules), it is necessary to reduce substance and ion losses in all steps from ion generation to ion measurement to a minimum. The yield from every step must be optimized.

The generation of ions for mass spectrometric analysis within a vacuum system, or even within an RF quadrupole ion trap, has the disadvantage that the substance molecules must be introduced into the vacuum system with a large surplus. On the one hand, this leads to the danger of condensation of substance molecules on the walls, which results in a build-up of charges on the surfaces and an impairment of function; on the other hand, the ion yield is generally very low for vacuum-internal ionization methods. For this reason, the tendency is more toward generating the ions outside the vacuum system of mass spectrometers, and transferring them by suitable methods into the ion trap.

One example of a vacuum-external ion sources is Electro Spray Ionization (ESI), by which substances of extremely high molecular weights can be ionized with a very high yield at atmospheric pressure. Electrospray is often coupled with modern separation methods such as liquid chromatography or capillary electrophoresis. Ion sources using ionization with Inductively Coupled Plasma (ICP), used for inorganic analysis, also belong to the group of ion sources with vacuum-external ion generation. Finally there is the so-called Atmospheric Pressure Chemical Ionization (APCI) with primary ionization of the reactant gases using corona discharges or beta emitters with electrons emitted at low energy. APCI is used, among other things, for the analysis of pollutants in air and is also especially suitable for coupling mass spectrometry with gas chromatography, liquid chromatography and capillary electrophoresis. Other types of vacuum-external ion sources such as Grimm's hollow cathode discharges or Matrix-Assisted Laser Desorption and Ionization (MALDI) in air are still being analyzed and developed.

According to the previous customary practice, the ions from these ion sources are admitted into the vacuum of the ion trap mass spectrometer with large amounts of ambient gas. For this, fine apertures of about 30 to 300 micrometers in diameter, or 10 to 20 centimeter long capillaries with an inside diameter of about 500 micrometers are used. The excess gas must be removed by differentially operating pump stages; on commercially available mass spectrometers, two or even three differential pump stages, with a suitable number of chambers, before the main chamber of the mass spectrometer are used. This means that three to four pumps are used. The chambers are joined to one another only by very small apertures, and the ions are passed through these small apertures.

The pressure in the first differential pump chamber on a standard mass spectrometer usually is several millibar, in the second differential pump chamber it is about $10^{-3}$ to $10^{-1}$ millibar, if only two differential pump chambers are used, and only in the main vacuum chamber it is $10_{-6}$ to $10^{-4}$ millibar. The mass spectrometer is located in the main vacuum chamber. The ions must be passed through the differential pump chambers and the small apertures between the chambers, which results in great ion losses.

To transfer the ions through these chambers more effectively, RF multipole ion guides are often used, which however can only be used at pressures under several $10^{-2}$ millibar, for otherwise electrical discharges could result. The ion guides can therefore only be used in the second differential pump chamber or in the main vacuum chamber. They are operated to advantage in a pressure range of several $10^{-3}$ millibar since they then dampen both the radial oscillations and the longitudinal motions of the ions rapidly and thus offer good preconditions for further transport of the ions and their analysis in the mass spectrometer.

The temporary storage of ions in one of the RF ion guides used upstream of the quadrupole ion trap is already a great advancement in respect to the aforementioned optimization of ion utilization. In this way it is possible to temporarily store ions from a continuously operating ion trap in such a way that the quadrupole ion trap is charged with ions in a relatively brief filling time, the ions being temporarily stored during the longer lasting analysis time. In particular, ions in the RF ion guide can be decelerated to thermal energies ("thermalized"), whereby their capture in the quadrupole ion trap is improved. The RF ion guide consists of a cylindrically arranged system of parallel rods to which the two phases of an RF voltage are applied alternately. Quadrupole, hexapole and octopole systems have proven effective for this. Other RF ion guide systems have also become known in the meantime and may be used.

Up to now, however, a critical step has still been the introduction of the ions from the RF ion guide into the quadrupole ion trap. Little is known about the capture process of the ions in the quadrupole ion trap. Our own investigations—both experiments on ion traps as well as computer simulations—have shown that ions can only be captured in a very brief interval of a small percent of the full period of the storage RF (also known as the driving RF). They must be completely decelerated by the opposing field prevalent at the injection time. The deacceleration standstill should be at about the same time as the zero sweep of the storage RF, the ions must therefore be able to be decelerated by the opposing field within a half cycle. Then capture is even possible without the presence of a damping gas. The length of the interval for successful capture depends on the injection energy of the ions and the deceleration gas pressure in the ion trap. A higher pressure for the deceleration gas improves the capture, the capture interval being extended in this way. In the remaining RF cycle, the ions are either reflected by the opposing field at the input to the quadrupole ion trap or else—in more than 50% of the remaining time—accelerated within the ion trap toward the end cap facing the input and thus removed from further utilization.

OBJECTIVE OF THE INVENTION

It is the objective of the invention to find a device and a method with which the ions generated outside the ion trap can be injected into the ion trap in such a way that they are captured as completely as possible and without loss of ions by the storage field of the ion trap. It should particularly be possible to also capture ions of different masses at the same time in an optimum manner.

DESCRIPTION OF THE INVENTION

It is the basic idea of the invention to feed ions into an electrical travelling field which transports them as ion packages of equal velocities toward the entrance opening of the ion trap. If the travelling field is operated at the frequency of the storage RF voltage (drive voltage of the ion trap), and if the injection phase is optimized relative to the phase of the drive voltage by adjustment, ions can then be captured almost completely provided that they have the same ratio of mass to charge (m/e).

The travelling field can be generated within a package of coaxially arranged and electrically isolated rings, washers, or aperture diaphragms. An n-phase rotational RF voltage must be generated for this and the phases must be connected cyclically to subsequent rings. If for example a six-phase alternating voltage is generated, the first phase is joined with rings 1, 7, 13, 19 etc., phase 2 with rings 2, 8, 14, 20 etc., etc. In this way, an electrical travelling field is produced within the package of rings in a known manner, and potentials of the same phases shift along the axis of the package. If a potential minimum is filled with ions at the start of the ring package, this potential minimum moves along the axis of the package and takes along the ions contained within it. At first there is acceleration of the ions until a velocity equilibrium has established itself. A damping gas can help reduce the oscillation of the ions around a medium velocity.

The travelling field can be operated at the frequency of the drive voltage, which generally is about one megahertz. If only one single ion is injected into the ion trap per potential minimum on average, the ion trap, which can only accept about 10,000 ions, will be filled in this way in the short time of only 10 milliseconds. Using this frequency however, the energy of heavy ions will be very high owing to the high velocity thus generated. If for example the washers are at a distance of half a millimeter from one another and the drive voltage has a frequency of one megahertz, the velocity when using a six-phase rotational voltage is 3,000 meters per second. For singly charged ions of 1,000 atomic mass units, this means an energy of almost 50 electron volts, an energy which cannot be decelerated for this mass in an ion trap within a half cycle.

For ions of larger masses, it is therefore absolutely necessary to use a lower frequency for the travelling field. The energy of the ions is reduced reciprocal to the square of the frequency and the square of the resulting velocity. In order to always inject the ions at the same phase of the drive frequency, the travelling field frequency must be an integral fraction of the frequency of the drive voltage, and must be locked to the phase of the drive voltage. Frequencies which are about one tenth of the drive voltage frequency, i.e. about 100 kilohertz, are favorable. For a travelling field according to the above example, the velocities are then 300 meters per second and the energy of about 0.5 electron volts can be decelerated even in moderate opposing fields of the order of 100 volts per centimeter within the ion trap in far less than one half cycle of the drive voltage.

When operating at 100 kilohertz, if every minimum is filled with an average of only one ion, the filling of the ion trap will last about 100 milliseconds. For a filling of every minimum with about 10 ions (still far below any space-charge impediment), filling of the ion trap again lasts only 10 milliseconds.

As can be seen from these observations, lower frequencies for the travelling field can also be used for injection. For a 30 kilohertz travelling field frequency (100 meters per second), ions of a mass between 3,000 and 10,000 atomic mass units can still be captured even without the presence of a deceleration gas. This low travelling field frequency is however generally not necessary since ions of very heavy masses are easier for the damping gas to capture than light ions due to their high collision cross section.

If an ion is accelerated in a wave trough without damping, it will oscillate in the wave trough around the average velocity of the wave trough. This is not favorable for the injection. It is therefore a further basic idea of the invention to dampen the oscillations relatively strongly using gas damping within the travelling field. A favorable pressure for the damping gas is between $10^{-3}$ and $10^{-2}$ millibar.

In the wave trough, a defocusing effect prevails for ions. They are deflected toward the outside unless they are flying exactly in the axis of the travelling field. To compensate for this effect, a static DC field can be superimposed on the travelling field, which is positive for every second aperture diaphragm, and negative for the ones in between. Therefore for every second alternating voltage phase, a positive DC voltage must be superimposed. This creates a focusing effect within the travelling field which is similar to the effect of a series of Einzel lenses.

If ions of several m/e ratios are generated in the ion source used, only the ions of a single m/e ratio can be captured optimally with this arrangement, other ions suffer losses since they are not injected at the correct time. Ions of smaller masses have lower energies at the same velocity and require later injection to be decelerated within the electrical braking field of the ion trap just before the zero sweep of the alternating voltage. This later injection of smaller masses can be achieved by three differing measures.

First, the ions can be decelerated between the output from the travelling field and the end cap by an electrical opposing field. This opposing field can be produced by a voltage between the zero potential of the travelling field and the end cap. All ions thereby suffer a drop in energy which corresponds to this potential difference. In this way lighter ions are decelerated more than heavier ones. They then arrive, as required, at a later phase in the opposing field of the ion trap. There is even a bottom cutoff threshold for the m/e ratio similar to the cutoff threshold of a quadrupole storage field.

Second, a collision gas in the path between the end of the travelling field and the injection hole of the ion trap decelerates the lighter ions more than the heavy ones, in which case the lighter ions reach the ion trap at a somewhat later time.

Third, the travelling field can itself be designed in such a way that the particles are decelerated toward the end. This is best achieved by reducing the spacing between diaphragms toward the end of the travelling field. In this way, all particles are decelerated, but since the larger ions require a longer slowing-down path due to their inertia, they are much less decelerated than the lighter particles. Thus all particles are decelerated, but since the heavier ions need a longer slowing-down path due to their inertia, they are much less decelerated than the lighter particles. They therefore leave the travelling field at a greater velocity, fly through the differential path faster toward the end cap and thereby arrive, again in the required manner, at the end cap sooner.

SHORT DESCRIPTION OF THE FIGURES

FIG. 1 shows an arrangement made up of a multipole field (1) with rod-shaped electrodes, a 6-phase travelling field (2)

with connections (3) for the first, and (4) for the fourth phase of the rotational alternating voltage (the other connections are not visible in the sectional drawing), and with the RF quadrupole ion trap which is made up of an injection end cap (5), the ring electrode (6) and the final end cap (7). The ring electrode is supplied via the connection (8) with drive alternating voltage for the ion trap.

Figure 4:
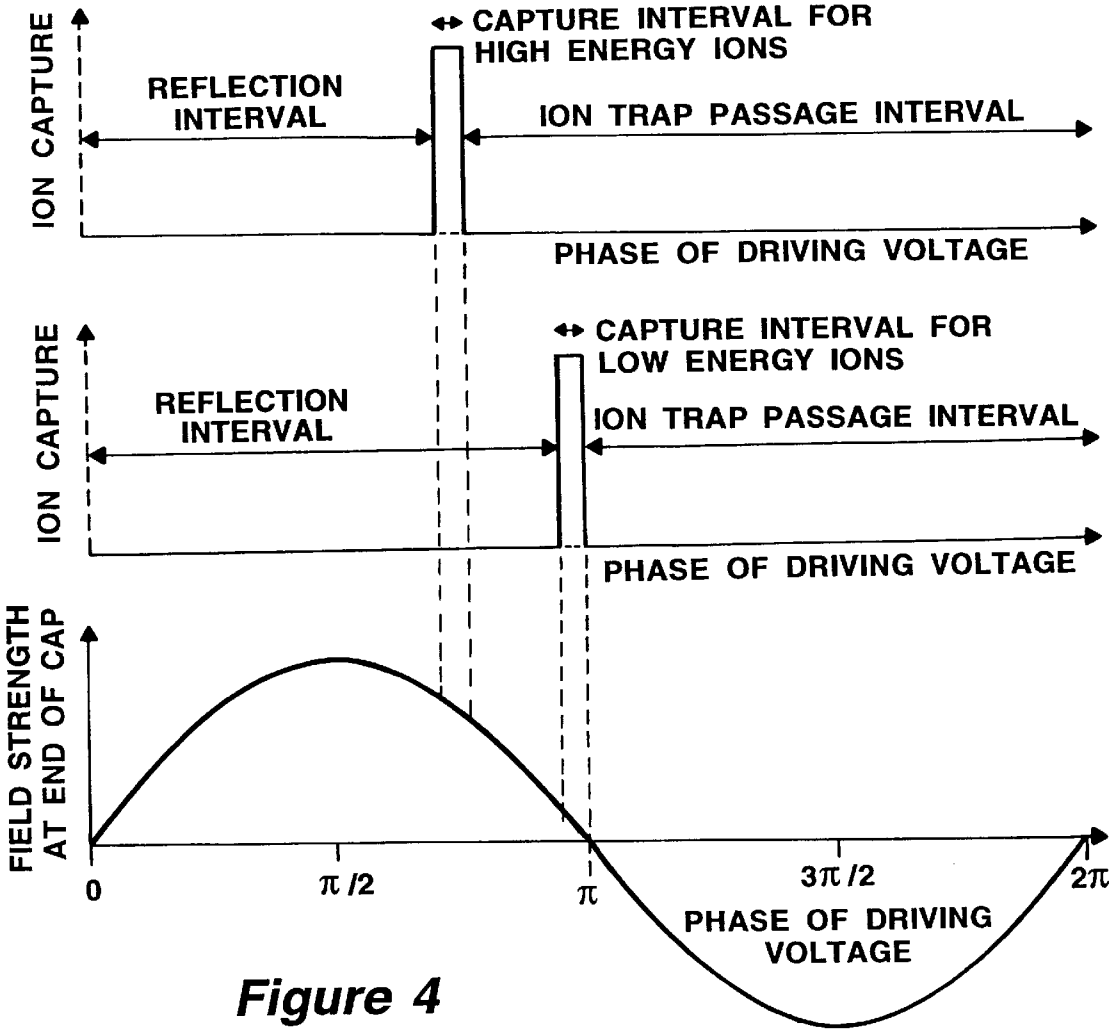

FIG. 4, in three stacked diagrams, shows the capture intervals for a heavy and a light ion, each relative to the cycle of the drive alternating voltage.

PARTICULARLY FAVORABLE EMBODIMENTS

Figure 1:
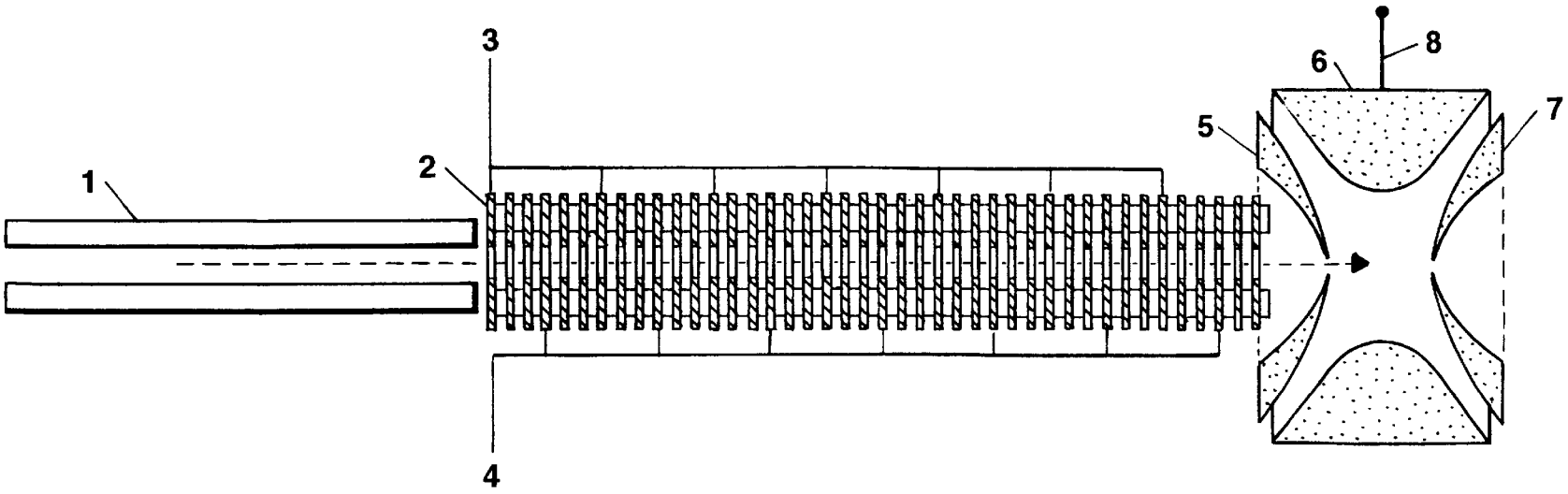
Figure 2:
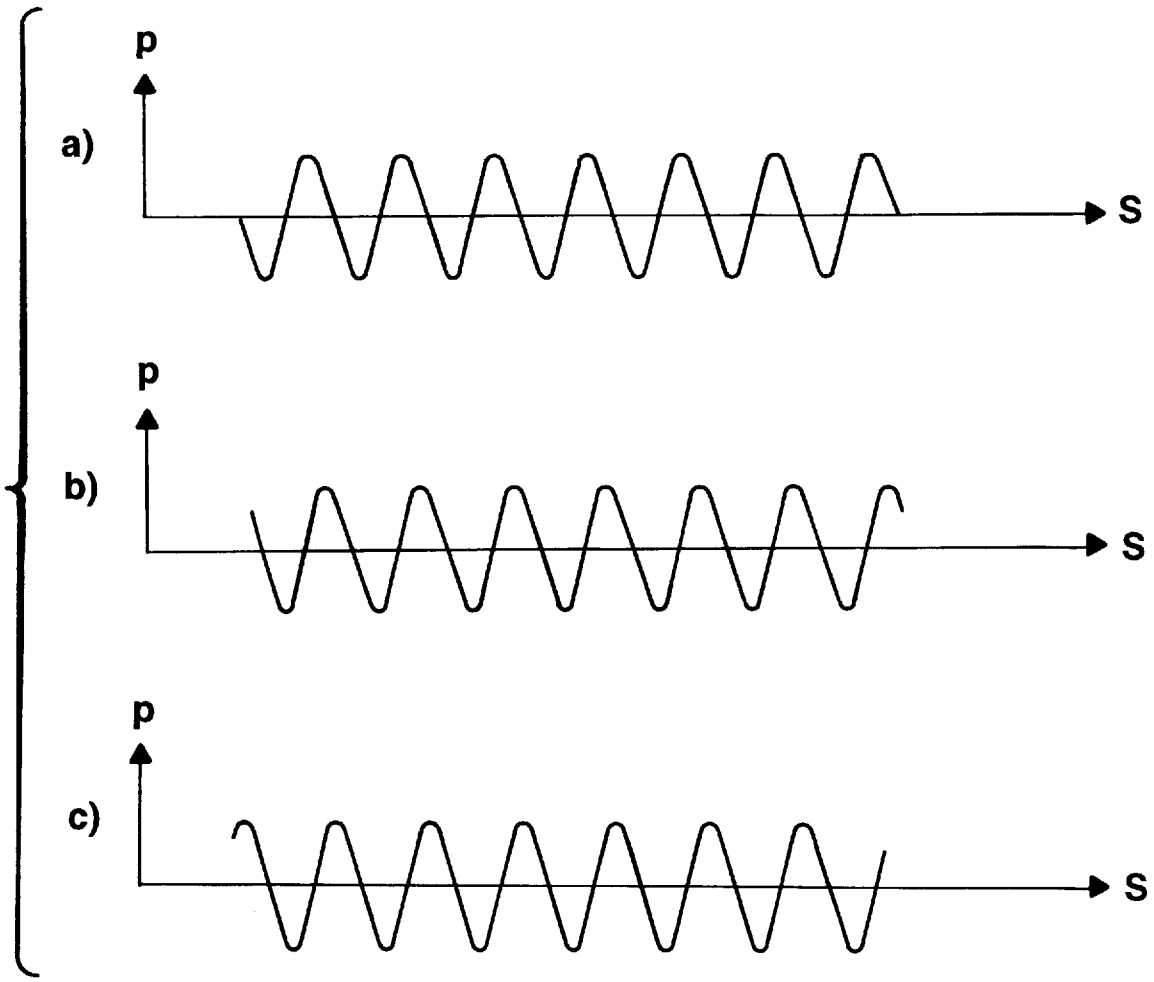
FIG. 2 shows the potential distribution p in the travelling field apparatus along the axis s at three consecutive times (a), (b) and (c). The temporal forward drive of the potential minima is apparent.
Figure 3:
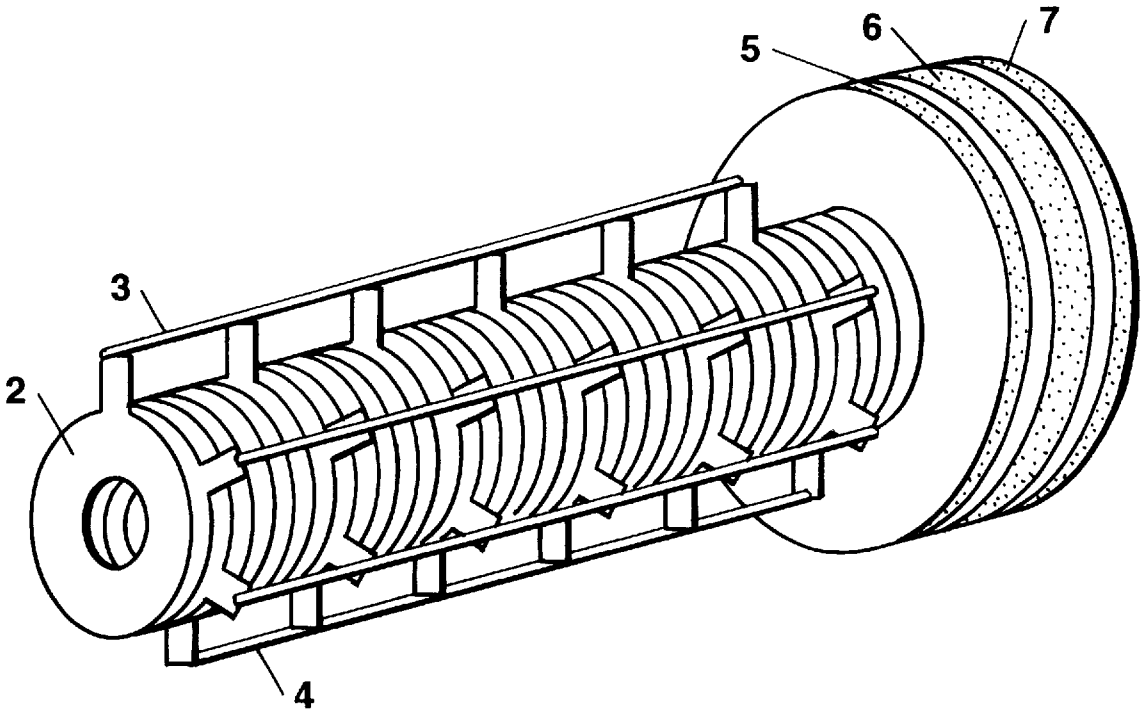
FIG. 3 shows the spatial arrangement of the travelling field apparatus (2) with the above described connections (3) and (4) and the ion trap with end caps (5, 7) and ring electrode (7).

FIG. 1 shows a basic design of the invention. Arranged between a multipole rod system (1), which serves as an ion guide system, and the RF quadrupole ion trap (5, 6, 7) is the travelling field apparatus (2) made up of washer-like aperture diaphragms insulated from one another (insulation not shown). The aperture diaphragms are spaced half a millimeter from one another and are sequentially joined with the six phases of a 6-phase rotational alternating voltage. The leads (3) and (4) are shown for phases 1 and 4, the other leads are not visible in the sectional diagram, but may be seen in the three-dimensional depiction in FIG. 3.

The frequency of the travelling field, at 100 kilohertz, is exactly one tenth the frequency of the drive voltage of the ion trap. The spatial cycle length of the travelling field with six phases comprises six aperture diaphragms, and is therefore 3 millimeters long. Therefore the travelling velocity of the travelling field is 300 meters per second, and the ions captured in each potential minimum at the front end of the device are accelerated to this velocity. Singly charged ions of a mass of 100 atomic mass units thereby have an energy of 0.05 electron volts, those of 1,000 atomic mass units have an energy of 0.5 electron volts, and those of 10,000 atomic mass units have an energy of 5 electron volts. The latter can no longer be decelerated within a half cycle of drive voltage in the ion trap if this is limited to about 100 volts per centimeter at the end cap, but this will function for ions of up to approx. m/z=2,000 atomic mass units per electron charge.

In the travelling field path, however, the accelerated ions vibrate in the moving potential minima if their oscillation motions are not dampened by a collision gas. For short travelling field paths of about 6 centimeters length (about 20 cycles), the damping must be relatively high, and pressures between 1 and 100 pascal ($10^{-2}$ to 1 millibar) are appropriate here.

The ions in the travelling field can be focused if every second aperture diaphragm is superimposed by a small positive DC voltage and the aperture diaphragms in between are superimposed by a small negative DC voltage. The superposition is simply supplied to every second phase. The aperture diaphragms then function like a series of Einzel lenses. Normal operation without a travelling field can then be attained by switching off the travelling field voltage, and the aperture diaphragms function like an ion guide system made purely of lenses, due to the spatially alternating DC voltages.

Capture of the ions is optimized by adjusting the phase relationship between the travelling field frequency and that of the ion trap. This optimization, however, only applies to ions of a certain ratio of mass to charge (m/e). Ions of other m/e ratios injected at the same time do not meet their capture interval without special measures and are therefore not continuously stored for long in the ion trap.

Collision gas pressure between the travelling field path and the injection hole in one of the end cap electrodes of the ion trap has a favorable effect on the simultaneous capture of heavier and lighter ions. Ions of a low mass are more strongly decelerated in this collision gas than those of a high mass. Therefore they arrive, as required, later in the ion trap and thereby increase their chance of capture.

A light deceleration voltage between the travelling field and end cap electrode has the same effect, although there is a bottom cutoff threshold for the ions. Ions with an energy of only 0.05 electron volts cannot overcome a potential barrier of 0.1 volts.

Delay of the lighter ions compared to the heavy ones can however also be achieved by a different design of the travelling field. If the spacings between the aperture diaphragms become smaller toward the end of the travelling field path, the ions are decelerated here. In this way, the light ions are decelerated quickly, while the heavy ones are decelerated slowly. When leaving the travelling field, the heavy ions are faster, reaching the end cap earlier as required.

I claim:

1. Method for injecting externally generated ions into an RF quadrupole ion trap through an injection hole in one of a plurality of trap electrodes, comprising the steps of (a) creating an electrical travelling wave field in front of the trap's injection hole, the frequency of which is phase-locked to the frequency of the ion trap's RF, and the travelling direction of which is pointed towards the injection hole, (b) filling the ions into potential minima at the front end of the electrical travelling wave field, whereby the ions are separated into ion packets, and the ion packets are transported by the travelling wave field towards the injection hole of the ion trap, and (c) injecting the travelling ion packets into the ion trap at a selected phase angle of the RF frequency.

2. Method as in claim 1, wherein the travelling wave field is generated by coaxial aperture diaphragms, to which the phases of a multiple phase alternating voltage are applied, and wherein the alternating voltage has a frequency which is the same as the RF drive frequency of the ion trap or is an integral fraction of the RF drive frequency.

3. Method as in claim 2, wherein the phases of the alternating voltage are alternately superimposed with positive and negative DC voltages.

4. Method as in claim 2, wherein spacing between aperture diaphragms decreases toward the ion trap's injection hole.

5. Method as in claim 1, wherein a deceleration voltage for the ions is applied between the travelling wave field and the ion trap.

6. Method as in claim 1, wherein the travelling wave field and the space between the travelling wave field and the ion trap are filled with a collision gas.

7. Method as in claim 6, wherein the collision gas has a pressure of 0.01 to 10 pascal.

8. An RF quadrupole ion trap for the storage of externally generated ions, comprising:

(a) an ion trap with end cap and ring electrodes, and an injection hole in one of the electrodes, (b) a generator for generating an RF drive voltage, (c) a series of coaxial aperture diaphragms designed as a travelling field apparatus, acting as an injection device for injecting the externally generated ions, and (d) a generator for generating a multi-phase AC voltage for the travelling wave field apparatus.

9. The ion trap as in claim 8, wherein the diaphragms are sequentially connected with output phase voltage connectors of the multiple phase alternating voltage generator.

10. The ion trap as in claim 9, wherein the AC voltages of the multi-phase alternating voltage generator are superimposed with DC voltages.

11. The ion trap as in claim 8, wherein the multi-phase alternating voltage generator produces a voltage with a basic frequency which corresponds to the frequency of the RF generator for the drive voltage of the ion trap or an integral fraction of the RF frequency.

* * * * *